United States Patent [19]

Evin

[11] Patent Number: 4,700,811

[45] Date of Patent: Oct. 20, 1987

[54] METHOD FOR THE REGULATED CONTROL OF A MOVING BODY CARRYING A VARIABLE LOAD

[75] Inventor: Jean Evin, Pont a Marcq, France

[73] Assignee: Sarl Logilift, Avelin, France

[21] Appl. No.: 843,255

[22] Filed: Mar. 24, 1986

[30] Foreign Application Priority Data

Mar. 25, 1985 [FR] France ..... 85 04879

[51] Int. Cl.[4] ..... B66B 1/28

[52] U.S. Cl. ..... 187/116; 187/119

[58] Field of Search ..... 187/29, 116, 119; 364/506

[56] References Cited

U.S. PATENT DOCUMENTS

| | | | |
|---|---|---|---|
| 2,403,125 | 7/1946 | Santini et al. | 187/29 R |
| 3,783,974 | 1/1974 | Gilbert et al. | 187/29 R |
| 3,918,552 | 11/1975 | Kameyama et al. | 187/29 R |
| 4,053,742 | 10/1977 | Halase, III et al. | 364/506 |
| 4,380,049 | 4/1983 | Makinen | 187/29 R X |
| 4,485,895 | 12/1984 | Tachino et al. | 187/29 R |

*Primary Examiner*—William M. Shoop, Jr.
*Assistant Examiner*—W. E. Duncanson, Jr.
*Attorney, Agent, or Firm*—Dennis P. Clarke

[57] ABSTRACT

The invention provides a method for the regulated control of a moving body carrying a variable load driven along a predetermined path for slowing it down gradually and stopping it accurately at a given point, more particularly the car of an elevator installation.

It is characterized in that:

the possible slowing down references are all of different slopes and are defined as a function of the load carried by the moving body to be slowed down, the magnitude ($G_e$) representative of the energy consumed is measured before entering the slowing down phase, it is from the estimated load ($C_e$) that, for the slowing down phase of the moving body, the reference chosen from the set of references (20 to 23) is imposed as being the one having a slope suitable for the estimated load.

9 Claims, 4 Drawing Figures

_FIG:1_
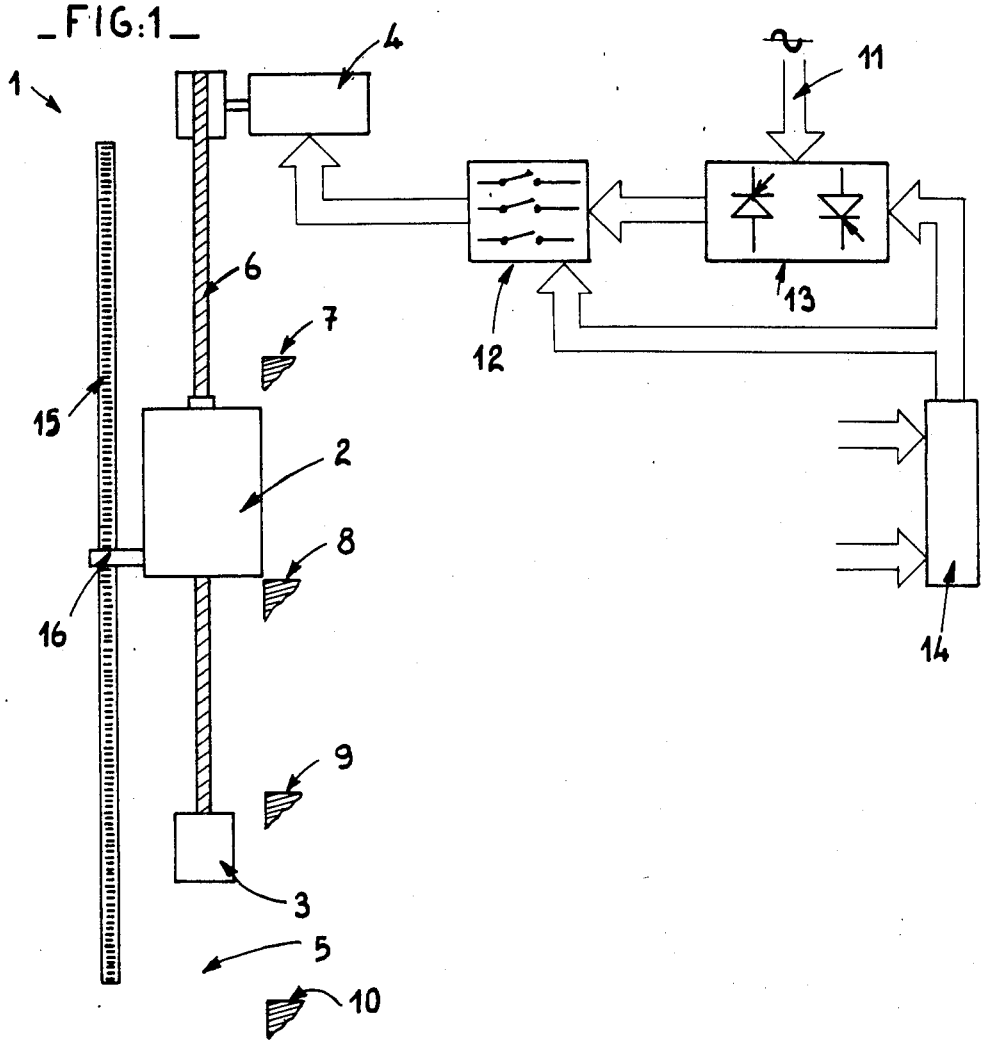
_FIG:2_
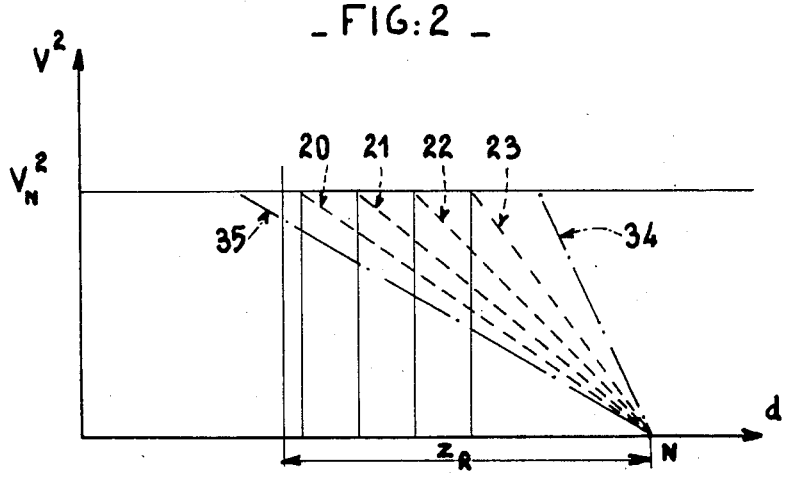

_FIG:3_
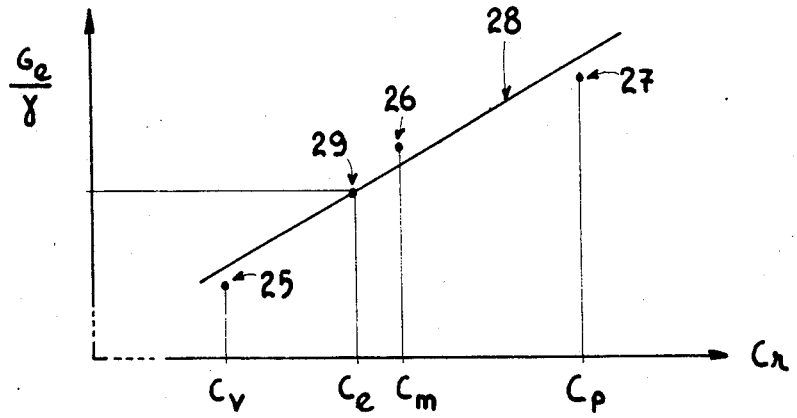
_FIG:4_
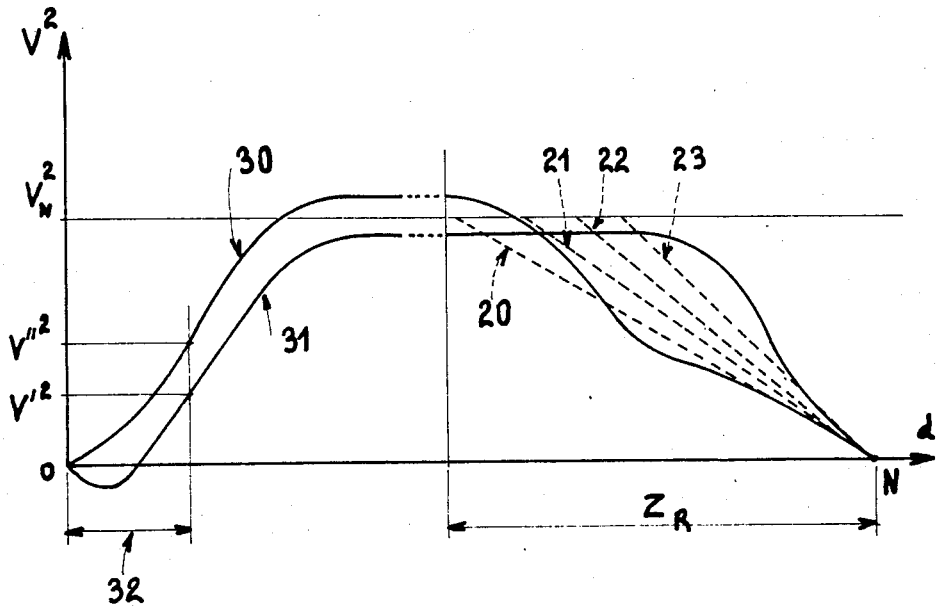

METHOD FOR THE REGULATED CONTROL OF A MOVING BODY CARRYING A VARIABLE LOAD

The invention relates to a method for the regulated control of the slowing down of a moving body driven by a motor.

The invention also relates to a regulated control device for putting this method into practice.

More particularly, but not exclusively, the invention relates to the control of a moving body carrying a variable load for driving it along a predetermined path either for gradually slowing it down and stopping it accurately at a predetermined point, or for keeping it at a stable speed less than its normal speed.

More particularly, but not exclusively, the invention applies both to the slowing down of an elevator car for stopping it accurately and comfortably at the height of a given level and to keeping it at a low speed for example for inspection or overhaul.

At the present time, in the application to an elevator installation, it is known to apply to the motor a regulated control at start up then in normal operation and finally on slowing down, so as to improve the comfort of the users, in particular with respect to the results obtained with installations comprising two speed drive motors and installations in which the slowing down is mainly provided by a mechanical brake.

At the present time it is known to apply to an electric drive motor an electric regulated slowing down control which ensures gradual braking of the movement of the car and an accurate stop at a given level, which further provides a feeling of optimum comfort for the users.

Thus, it is known to control the slowing down of an elevator car in accordance with a reference of its speed as a function of time or better still a reference as a function of its speed and of the distance which remains to be covered for reaching the level.

A regulated control of this latter type is known for example for a three phase drive motor which brakes the motor by phase reversal, by modulating the control voltage.

Such regulated controls give good results to the extent that they slow down the car from an electric control applied to the motor, which avoids using mechanical braking means, the brake only being used for holding the car in its stopped position.

Furthermore, such regulated controls efficiently provide gradual slowing down of the car and a precise stop, which gives the users a great feeling of comfort for there is a total absence of jerks.

However, for existing systems, very often only a single slowing down reference is defined or only references with identical slopes which, in particular, do not take into account the real load transported by the car.

Thus, to slow down and stop a fully loaded car travelling downwards, more energy is required than for slowing down an empty car for the same slowing down reference.

This causes then in some cases an excessive consumption of energy and, sometimes, excessive heating of the drive motor.

One of the aims of the present invention is to overcome these disadvantages and to provide a method and device for the regulated control of the slowing down of a moving body which, either for stopping it with precision, or for keeping it at a low speed, allow a slowing down reference to be imposed adapted to the load carried by the moving body.

Another aim of the present invention is to provide a regulated slowing down control method and device which optimize the energy consumed in the slowing down phase.

Another aim of the present invention is to provide a method and device for the regulated control of the slowing down of a moving body which reduce heating of the drive motor during the slowing down phase.

Other aims and advantages of the present invention will be clear from the following description.

To this end, the invention provides a method for the regulated control of the slowing down of a moving body carrying a variable load, more especially but not exclusively a car of an elevator installation, for driving it along a predetermined path whether the regulation is operative for slowing this moving body down gradually and stopping it accurately at a predetermined point such as a given level, or for keeping it at a so called low speed because it is less than its normal speed, in which method:

a set of possible slowing down references are defined beforehand, at least one magnitude representative of the energy consumed by the motor for driving the moving body over a predetermined distance is measured, from said magnitude representative of the energy consumed the load is calculated which is estimated to be carried by the moving body, for the slowing down phase of the moving body, one of the slowing down references is imposed chosen from the set of possible references.

This method is more particularly characterized in that:

the possible slowing down references are all of different slopes and each defined as a function of a load carried by the moving body to be slowed down, the measurement of the magnitude representative of the energy is measured before entering the slowing down phase, depending on the estimated load, for the slowing down phase of the moving body, the reference chosen from the set of references is imposed as being the one having a slope suitable for the estimated load.

It also provides a device for putting the method into practice which comprises:

means for measuring at least one magnitude representative of the energy consumed by the motor for driving the moving body over a predetermined distance during the start up phase of the moving body preceding the slowing down phase, means for working out an estimation of the load carried by the moving body from said magnitude representative of the energy consumed, means for imposing, during the slowing down phase of the moving body, the reference best adapted to the estimated load carried by the moving body chosen from the set of possible references.

The invention will be better understood from the following description, made for the non limitative application to an elevator installation, with reference to the accompanying drawings which show schematically:

FIG. 1: a view of an elevator installation,

FIG. 2: a graph illustrating the different possible slowing down references,

FIG. 3: a graph illustrating an initialization mode, and

FIG. 4: a graph illustrating the speed of the car for two different loads.

For facilitating understanding of the invention, the following description will be made by way of non limitative example in the application to an elevator installation 1 comprising a car 2, a counterweight 3 and an electric drive motor 4, possibly also comprising a winch (not shown) driving a cable 6 which is connected to the car 2 and to the counterweight 3.

Car 2 is movable inside a substantially vertical shaft 5, along an appropriate guide means which defines its predetermined path.

Furthermore, it serves a plurality of levels or floors which are shown schematically by way of illustration from 7 to 10.

This application is not limitative and the invention concerns generally any moving body driven by a motor along a predetermined path, not only vertically but also horizontally or obliquely, the aim attained by the invention being to apply to the drive motor a regulated slowing down control which, depending on a slowing down reference adapted to its load, either slows the moving body down gradually and stops it with precision at a given point, or keeps it at a speed called low speed because it is less than its normal moving speed between the starting up and stopping phases.

Advantageously, the control means 14 comprise digital processing means, for example a microprocessor and its environment, as well as processing software.

The whole of these elements is at the present time known, and, advantageously, the regulated control applied to the motor means that the car can be started and slowed down with optimum comfort for the users while in particular avoiding any jerks.

Furthermore, the brake for blocking the motor 4 or its winch is only used when the shaft of the motor is stopped, which avoids any wear.

More particularly, by way of example, good results have been obtained for starting up the car 2, by applying to motor 4 a regulated open loop control which consists of a thyristor gate control incremented periodically in time, from a substantially zero value up to complete opening of the thyristors.

Depending on whether the car begins to move in the desired direction or in the opposite direction, the control means 14 generate a control applied to the thyristor gates with a low increment or else a high increment;

In the case where advantage is taken of the drive torque exerted by car 2 and its counterweight 3 on motor 4, a low increment is applied.

The high increment on the other hand is applied in the case when the car 2 and its counterweight exert a resistant torque on the motor, that is to say opposing the desired movement.

For the slowing down phase of the car, with a view to stopping it at the height of a given level, good results have been obtained by imposing on the car a speed reference defined by its speed as a function of the distance which remains to be travelled in order to reach the level.

These good results were obtained for a reference corresponding to a constant deceleration of the order of 0.50 $m/s^2$.

In some cases, in the final slowing down phase, a particular control allows the car to be stopped at the predetermined level without any jerking, therefore with optimum comfort for the users.

The invention proposes estimating dynamically the load carried by car 2 which varies depending on the number of users and their weight, and as a function of the load thus estimated, imposing on the motor 4 a so called slowing down control complying with a reference adapted to the load carried by car 2 and chosen from a set of possible references.

Thus, in the method of the invention, a set of possible slowing down references are constructed beforehand each corresponding to one of the different loads likely to be carried by the moving body.

In the case more particularly where a slowing down reference is imposed corresponding to an acceleration of a constant absolute value, the set of references is defined for different constant absolute values of this acceleration.

FIG. 2 shows by way of illustration four curves 20 to 23 of references for slowing down the speed of car 2 as a function of the position of car 2 with respect to the level N to reach.

These curves 20 to 23 correspond to different constant absolute values of the acceleration.

Their number is not limitative, and by way of non limitative example, a set of eight instructions may be adopted for slowing down the speed as a function of the distance for accelerations varying in absolute value from 0.35 to 0.55 $m/s^2$ in steps of 0.025 $m/s^2$.

The reference curves 20 to 23 are preferably memorized in control means 14, in any appropriate form known to a man skilled in the art.

In the case where the control means 14 comprise a digital computer, the instruction curves may be stored in a ROM or may be calculated at the time of bringing installation 1 into service, as a function of the parameters of the site and may be stored for example in a safeguared RAM or in a ROM which may be cleared and reprogrammed by the computer itself.

In order to optimize both the comfort of the user and the energy required for slowing down motor 4, the control means 14 impose a slowing down reference chosen from the set of references 20 to 23, this reference being the best adapted to the load carried by car 2.

In order to estimate the load $C_e$ carried by car 2, the invention proposes measuring a magnitude $G_e$ representative of the energy consumed by motor 4 for driving car 2 over a predetermined distance, in a phase of its operation directly preceding its slowing down phase. For example, the control means 14 measure the power consumed by the motor over a predetermined distance, in the phase of its operation where its speed has reached a level stretch just before its slowing down phase.

However, preferably, it is in the start up phase of car 2 and motor 4 preceding the slowing down phase considered that the control means 14 measure the magnitude $G_e$ representative of the power consumed by motor 4 for driving car 2 over a predetermined distance In addition, the predetermined distance preferably starts from the last stopping point of the car 2 preceding its slowing down phase.

Thus, the magnitude $G_e$ is measured in the first phase of starting up car 2, from a zero speed.

The magnitude $G_e$, itself, is of any appropriate type and it is measured by any appropriate means. In the case of a control regulated by thyristors, good results have been obtained by measuring the magnitude $G_e$ from the thyristor gate control of the power stage 13 and more precisely by taking directly as magnitude $G_e$ the last value of the thyristor gate control at the moment when car 2 has travelled said predetermined distance.

It must be emphasized that in the case where the control means 14 are of digital type, this value is directly available within means 14.

Moreover, good results have been obtained with a predetermined distance of about 3 cm, with as starting point the last stopping point of the car preceding the slowing down phase considered.

The control means 14 calculate the estimated load $C_e$ carried by car 2 from the magnitude $G_e$ and also from the value of the speed reached by the car at the end of said predetermined distance.

In the case of the installation shown schematically in FIG. 1, the speed is directly available at the control means 14 from information transmitted by the reader 16 of the coded strip 15.

It could also be obtained in a similar way from reading a coded disk or drum, or else from a tachometric generator.

Depending on the value of the speed V of car 2 at the end of said predetermined distance, the control means 14 generate, by processing, an approximate value of the acceleration $\gamma$ of the car over said predetermined distance.

The acceleration may be calculated, except for a multiplicative constant, by differentiation of the speed or by squaring the speed.

By establishing the ratio between the magnitude $G_e$ representative of the energy and the acceleration $\gamma$, the control means 14 calculate, except for a constant, an estimation $C_e$ of the load carried by the car.

This latter operation requires initialization of the computing means, one method of which is shown by way of illustration in FIG. 3.

In the method of initialization shown, the magnitude $G_e$ and the speed V of the car are measured for a predetermined distance from start up of car 2 for a real unladen weight Cv, for a real full load Cp and for a real half load Cm of car 2.

More exactly, the unladen weight Cv corresponds to a maximum drive torque exerted on the motor, i.e. an ascent when empty or a descent with full load, the full load corresponds to a maximum resistant torque exerted on the motor, i.e. an ascent with full load or descent when empty.

The three initialization measurements are shown in FIG. 3 by three points 25, 26, 27 from which the control means 14 establish a linear relationship shown schematically by the straight line 28 between the measured magnitudes $G_e$ and V, after processing, and the estimated load Ce carried by the car, which is illustrated with point 29.

Referring again to FIG. 2, depending on the estimated load $C_e$ calculated by the control means 14, these latter impose that one of references 20 to 23 which is the best adapted to the load $C_e$ of car 2.

Such a correspondance between the estimated load and the reference chosen from a set of references is formed for example by dividing the load range into as many segments as there are possible references and by causing each reference to correspond to an estimated load segment. It should be emphasized that the estimated load depends not only on the real load carried by car 2, but also on its direction of movement.

In fact, the estimated load $C_e$ will not be the same for the same real load defined, if the cabin is going up or if it is going down because of the gravity phenomenon which, depending on the direction of movement of the car and its total weight with respect to that of the counterweight, may have a favorable or unfavorable effect on its slowing down.

The method of calculating the estimated load $C_e$ however allows this load to be estimated directly without having to take into account the direction of movement of the moving body.

Referring to FIG. 2, curve 23 shows the steepest slope which will be imposed by the control means 14 in the case where car 2 and its counterweight 3 exert a resistant torque on motor 4, i.e. in the case of an estimated load $C_e$ close to the full load Cp such as defined above.

On the other hand, the curve 20 with lowest slope will be imposed for a drive torque exerted by car 2 and its counterweight 3 on motor 4, that is to say for an estimated load $C_e$ close to the unladen weight Cv such as was defined above.

By choosing the slowing down reference from a set of possible references, the energy consumed by motor 4 for slowing it down and stopping it may be optimized and excessive heating of the motor may further be avoided.

Moreover, this possibility of choice improves the comfort of the users.

FIG. 4 shows by way of illustration a graph of the speed V of car 2 or more precisely of its square from a given level chosen as origin, to a level N.

In this Figure, however, in order to facilitate understanding the proportions have not been respected.

Curve 30 corresponds to a drive torque exerted by car 2 and its counterweight 3 on motor 4.

The car is therefore started up with a small increment and, such as was described above, at the end of said predetermined distance 32 the control means 40 estimate the load $C_e$ carried by the car from the magnitude $G_e$ representative of the energy consumed, and the speed V of car 2.

This calculation is preferably made immediately after travelling over said predetermined distance.

The speed of the car reaches its normal operating level and when the car enters the slowing down zone $Z_R$ for reaching level N, that is to say when it is at a distance at least equal to the largest distance required for slowing it down, with the above defined conditions of comfort, control means 14 choose from the set of references 20 to 23, the reference corresponding best to the estimated load, namely in this case reference 20.

Curve 31 corresponds to a resistant torque exerted by the car and its counterweight 3.

In a known way, in the case of the regulated control considered, if the car starts moving in the opposite direction to the desired direction a high incrementation is applied to the control thyristors for the start up.

As for the previous case, at the end of said predetermined distance, the control means 14 measure the magnitude representative of the energy consumed $G_e$, as well as the speed V' of the car.

They calculate an estimation of load $C_e$ and, when the car enters the slowing down zone $Z_R$ for reaching level N, the computing means impose one of the slowing down reference, namely in the present case reference 23.

As shown in FIG. 4, despite entry into the slowing down zone $Z_R$, the speed level of curve 31 continues as far as the intersection with curve 23.

The regulated slowing down control is applied in any appropriate way and may for example consist of a control applied to the thyristor gates which depends on the difference between the real speed of the car and the reference speed as a function of the distance between the car and the level N to be reached.

It should be noted that, when car 2 travels over a short distance, for example for passing from one level to the adjacent level, and when it cannot reach its normal operating speed level, the control means 14 operate in a substantially identical way, since measurement of the parameters required for determining the estimated load $C_e$ is made on start up of the car.

In a way known per se, the actual slowing down of the car will then only be effective when its speed curve as a function of the distance intersects the reference curve imposed by the control means 14 for the estimated load $C_e$ calculated.

In a preferred embodiment the control means 14 in fact store a plurality of slowing down reference curves and, for the installation 1 considered, the set of possible slowing down references is at most included in this plurality.

In other words, generally, the control means 14 calculate and/or store a plurality of slowing down references and the installer, when setting up the installation, has the possibility of allowing from the plurality of references only those which are truly adapted to the installation considered 1 and to the useful load of car 2 which form the set of possible slowing down references.

By way of illustration, FIG. 2 shows beyond the reference curve 23 and short of the reference curve 20 two reference curves 34 and 35 stored by the control means 14 which are however prohibited because of the nature of installation 1, in particular because of the moving masses and the useful load of the car.

For example, curve 34 would cause slowing down of the car which in certain conditions would be too sudden whereas curve 35 would cause slowing down which is too long, these two curves therefore do not correspond to an optimum operation of the installation.

Depending on whether the estimated load $C_e$ will be driving or resistant, the slowing down will require the motor respectively to hold back or drive the load.

For that, in a preferred embodiment, regulation of the motor is provided by means of a graduator circuit, that is to say a circuit gradually closing or opening the thyristors which are then connected to the network after intersection of the phases for obtaining braking or in a direct phase for obtaining driving.

Of course, other means may be used and a man skilled in the art will be able to determine not only these means but the arrangement thereof.

In the above examples, the aim of the invention is to impose on the car of an elevator a slowing down sequence which, at the end of a slowing down zone $Z_R$, will lead to stopping thereof.

As mentioned above, the invention also allows the speed of the car to be stabilized close to a speed called low speed because it is less than its normal predetermined speed, for example for inspecting the shaft 5 of the elevator.

This possiblity is offered by the invention without it being necessary for all that to use additional means.

It is then sufficient to provide a slowing down reference of zero slope then, depending on whether the load is driving or resistant, to act as above for braking it or driving it at the chosen speed with an intensity depending on the estimated load and under the control of said reference.

This low speed reference may of course only be accessible to persons specially authorized and more particularly to the maintenance staff.

As was mentioned above, the invention applies not only to an elevator installation but generally to any moving body driven by a motor and which it is required to stop gradually with precision.

Similarly, the invention may be applied to different modes of supplying the motor, particularly, a DC mode and different regulation modes, for example by power transistor, triac, thyristor. . . .

Naturally, the present invention is only given by way of indication and other embodiments of the invention could be adopted without for all that departing from the scope and spirit thereof.

I claim:

1. A method for the regulated control of the slowing down of a moving body carrying a variable load, more especially but not exclusively a car (2) of an elevator installation (1) for moving it along a predetermined path, whether the regulation takes place for slowing down the said moving body gradually and stopping it accurately at a given point, such as a given level (N), or for keeping it at a speed called low speed because it is less than its normal speed, in which method:

a set of possible slowing down references (20 to 23) is defined beforehand, at least one magnitude ($G_e$) is measured representative of the energy consumed by a motor (4) for driving the moving body over a predetermined distance (32), for the slowing down phase of the moving body (2) one of the slowing down references is chosen from the set of possible references (20 to 23), characterized in that:

the possible slowing down references are all of different slopes and each defined as a function of a load carried by the moving body to be slowed down, before entering the slowing down phase, the magnitude ($G_e$) representative of the energy consumed by the interval of the given distance is measured, the instantaneous speed of the moving body (2) is measured at the instant when it has traversed the interval of the predetermined distance, the estimated load ($C_e$) carried by the moving body (2) is calculated based on said magnitude ($G_e$) representative of the energy consumed for traversing the interval of the predetermined distance and as a function of the speed attained at the end of that interval, it is from the estimated load ($C_e$) that, for the entire slowing down phase of the moving body, the reference chosen from the set of references (20 to 23) is imposed as being the one suitable for the estimated load.

2. The method as claimed in claim 1, characterized by the fact that said magnitude ($G_e$) representative of the energy consumed by the drive motor (4) is measured over an interval of distance (32) travelled by the moving body (2) which is immediately adjacent the last stopping point of the moving body preceding its slowing down phase.

3. The method according to claim 1, characterized by the fact that, for calculating the estimated load ($C_e$) carried by the moving body (2), the computing means are initialized by measuring said magnitude ($G_e$) representative of the energy consumed and the speed (V) reached by the car at the end of said predetermined interval of distance for a real load when empty (CV), a real full load (Cp), a real half load (Cm), and from the initialization points (25, 26, 27) a linear relationship is established giving the estimated load ($C_e$) transported by the moving body according to a measured magnitude ($G_e$) and speed (V).

4. The method according to claim 1, applied to keeping the moving body at a speed less than its normal speed, characterized:

in that at least one constant speed threshold is defined beforehand and, in that at least one of the references is a slowing down reference with zero slope associated with said constant speed threshold so as to act with an intensity in harmony with the estimated load.

5. The method according to claim 2, characterized by the fact that generally a plurality of slowing down references is defined (20 to 23, 34 to 35) and for the installation (1) of the moving body (2) considered, only a set of references (20 to 23) is allowed which is included in said plurality of references and at most equal thereto.

6. The method according to claim 1, in which the motor is driven by an electric motor controlled by means controlling the supplying voltage, such as at least one thyristor thereof whose gate control is varied incrementally and periodically, characterized by the fact that the value of the thyristor gate control is taken at the moment when the moving body (2) has travelled over said predetermined interval of distance as a magnitude ($G_e$) representative of the energy consumed for travelling over said predetermined interval of distance.

7. The method according to claim 1, characterized by the fact that a plurality of slowing down references is defined corresponding to constant accelerations whose absolute value varies from about 0.35 m/s, to about 0.55 m/s, by steps of 0.025 m/s, and the magnitude ($G_e$) representative of the energy consumed and the speed of the moving body are measured for a predetermined interval of distance of about 3 cm immediately adjacent the last stopping point preceding start up of the moving body.

8. A regulated control device for slowing down a moving body carrying a variable load, more especially but not exclusively a car (2) of an elevator installation (1) for moving it along a predetermined path, whether the regulation takes place for slowing down the said moving body gradually and stopping it accurately at a given point, such as a given level (N), or for keeping it at a speed called low speed because it is less than its normal speed, comprising:

means for defining beforehand a set of possible slowing down references (20 to 23), means for measuring at least one magnitude ($G_e$) representative of the energy consumed by a motor (4) for driving the moving body (2) over a predetermined interval of distance, means for calculating the estimated load ($C_e$) carried by the moving body (2) from said magnitude ($G_e$) representative of the energy consumed, means for imposing on the slowing down phase of the moving body (2) one of the slowing down references from the set of possible references (20 to 23), this device being characterized, in view of putting into practice the method according to any one of claims 1 to 7, by the fact that it comprises in addition, means for storing beforehand a set of possible slowing down references (20 to 23) depending on the load carried by the moving body (2), means for measuring before the slowing down phase of the said moving body (2) at least one magnitude ($G_e$) representative of the energy consumed by the said motor (4) for driving the moving body (2) over a predetermined interval of distance, means for measuring the speed attained at the end of the predetermined interval of distance, means for calculating an estimation of the load ($C_e$) carried by the said moving body (2) from said magnitude ($G_e$) representative of the energy consumed and the speed attained at the end of the predetermined interval of distance, means for imposing on all of the slowing down phase of the said moving body (2) one of the slowing down references from the set of possible references (20 to 23) best corresponding to the estimated load ($C_e$) carried by the moving body.

9. The device according to claim 8, characterized by the fact that it additionally comprises:

means for initializing the computing means according to the magnitude ($G_e$) representative of the energy consumed and the speed (V) of the moving body (2) for a real load when empty (CV), a full load (Cp) and a real half load (Cm) and means for establishing, from the three initialization points (25, 26, 27) a linear relationship giving the estimated load ($C_e$) as a function of a measured magnitude ($G_e$) and speed (V).

* * * * *